US007823331B2

(12) United States Patent
Linkmeyer et al.

(10) Patent No.: US 7,823,331 B2
(45) Date of Patent: Nov. 2, 2010

(54) FRENCH DOOR SEAL HAVING A MAGNETIC PAIR

(75) Inventors: Gregory R. Linkmeyer, Laconia, IN (US); Michael J. Jackson, Nabb, IN (US)

(73) Assignee: Holm Industries, Inc., Scottsburg, IN (US)

( * ) Notice: Subject to any disclaimer, the term of this patent is extended or adjusted under 35 U.S.C. 154(b) by 918 days.

(21) Appl. No.: 11/560,565

(22) Filed: Nov. 16, 2006

(65) Prior Publication Data

US 2007/0125002 A1 Jun. 7, 2007

Related U.S. Application Data

(60) Provisional application No. 60/737,445, filed on Nov. 16, 2005.

(51) Int. Cl.
*E06B 7/16* (2006.01)

(52) U.S. Cl. ..... 49/478.1; 49/368; 49/366

(58) Field of Classification Search ..... 49/478.1, 49/475.1, 480.1, 366, 367, 368, 369; 312/296, 312/324, 405

See application file for complete search history.

(56) References Cited

U.S. PATENT DOCUMENTS

| | | | | | |
|---|---|---|---|---|---|
| 479,973 | A * | 8/1892 | Chase | 49/480.1 |
| 712,403 | A * | 10/1902 | Oldenburg | 49/480.1 |
| 1,948,017 | A * | 2/1934 | Wuebling | 49/416 |
| 2,767,040 | A * | 10/1956 | Kesling | 312/296 |
| 3,248,159 | A * | 4/1966 | Hall | 312/296 |
| 4,288,135 | A | 9/1981 | Buchser et al. | |
| 4,711,098 | A | 12/1987 | Kuwabara et al. | |
| 5,309,680 | A | 5/1994 | Kiel | |
| 5,375,376 | A * | 12/1994 | Scott | 49/480.1 |
| 5,816,080 | A | 10/1998 | Jeziorowski | |
| 5,908,228 | A * | 6/1999 | Lee | 312/405 |
| 5,975,661 | A | 11/1999 | Jeziorowski et al. | |
| 5,975,664 | A * | 11/1999 | Banicevic et al. | 312/405 |
| 7,178,293 | B2 * | 2/2007 | Kim | 49/478.1 |
| 7,556,324 | B2 * | 7/2009 | Benz | 312/405 |

* cited by examiner

*Primary Examiner*—Katherine W Mitchell
*Assistant Examiner*—Catherine A Kelly
(74) *Attorney, Agent, or Firm*—Harness, Dickey & Pierce, P.L.C.

(57) ABSTRACT

A seal assembly is provided for a side-by-side or French style door on a refrigerator in which the sealing gasket is supported on a gasket carrier and pivotably coupled to a base member adapted to be secured along the medial vertical edge of a refrigerator door. A set of magnets are supported by the gasket carrier opposite the gasket. These magnets are arranged such that similar poles are adjacent one another when the doors are in the closed position. The magnets provide a repelling force which operates to rotate the gaskets into sealing engagement with one another.

9 Claims, 6 Drawing Sheets

FRENCH DOOR SEAL HAVING A MAGNETIC PAIR

CROSS-REFERENCE TO RELATED APPLICATIONS

This application claims the benefit of U.S. Provisional Application No. 60/737,445, filed on Nov. 16, 2005. The disclosure of the above application is incorporated herein by reference.

FIELD

The present disclosure relates to a refrigerator door seal and more particularly a pivoting magnetically biased refrigerator door seal assembly for use in a side-by-side or french door style refrigerator.

BACKGROUND

The statements in this section merely provide background information related to the present disclosure and may not constitute prior art.

Domestic or residential refrigerators may be provided with a variety of door configurations depending on the size of the refrigerator, interior volume requirements and the consumer desires. One such configuration is a refrigerator having a side-by-side door with a freezer compartment on one side, a refrigerator compartment on the other side and a center mullion separating the compartments against which the side-by-side close and seal. In another configuration, the refrigerator may have a freezer compartment located above or below the refrigerated compartment with a pair of side-by-side doors. In this configuration, the vertical mullion is eliminated to increase the storage volume within the refrigerated compartment and to enhance accessibility thereto.

In the latter style refrigerators, it is necessary to provide a seal assembly between the facing surfaces of the door when the doors are in the closed position. More specifically, a seal assembly is provided along each medial vertical edge of the refrigerator door. Each seal assembly carries a compressible gasket which extends along the side face of each door and engages the compressible gasket carried on the opposite door when the doors are in a closed position. It is well known in the art to utilize magnets within these gaskets, and more specifically oppositely poled magnets beneath the sealing surfaces of the opposing gaskets to attract one another for developing a tight seal when the doors are aligned in a side-by-side closed position. While a seal assembly of this configuration may provide adequate sealing, there may exist a "scrubbing" problem in which movement of one door relative to the other causes the associated gasket to scrub along the entire vertical length of the opposing gasket. Gasket scrubbing can significantly reduce the longevity of the door seal integrity between the adjacent doors, thereby compromising the door seal. Furthermore, gasket scrubbing can reduce the perceived quality of the refrigerator by impeding smooth opening and closing the doors.

Accordingly, there is a need for an improved seal assembly for use in a side-by-side or French door style refrigerator that reduces or eliminates gasket scrubbing along the medial vertical length of the door, while maintaining adequate seal theretween when the doors are in a closed position.

SUMMARY

The present invention is directed to a door seal adapted to be secured along the medial vertical edge of a door for a side-by-side or French style refrigerator. A sealing gasket is supported on a gasket carrier that is pivotally coupled to a base member. The gasket carrier is configured to rotate towards the centerline of the refrigerator when the doors are in the closed position to engage one another and provide a seal therebetween. When one door is moved relative to the other, the gasket carrier counter-rotates to position the gasket away from the centerline of the refrigerator, thereby moving the gaskets out of engagement. With the seal broken, the doors may be moved relative to one another without causing scrubbing therebetween.

A set of magnets are supported by the gasket carrier opposite the gasket. These magnets are arranged such that similar poles are adjacent one another when the doors are in the closed position. Thus, the magnet provides a repelling force which operates to rotate the gaskets, located on the opposite side of the pivotal connection, into engagement with one another. A biasing member may be utilized to counter-rotate the gasket carrier as the doors move away relative to one another. In one embodiment, a spring mechanism is interposed between the gasket carrier and the base member to bias the gasket carrier. The magnet set is configured such that the repelling force generated thereby is sufficient to overcome the spring mechanism when the doors are in the closed position, thereby allowing the gasket carrier to rotate the gaskets into sealing engagement. In another embodiment, the biasing mechanism takes the form of each magnet set having a pair of oppositely poled magnets provided on each gasket carrier. As one door is moved relative to the other, the oppositely poled faces of the magnets sets align to provide an attractive force, thereby counter-rotating the gasket carrier.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
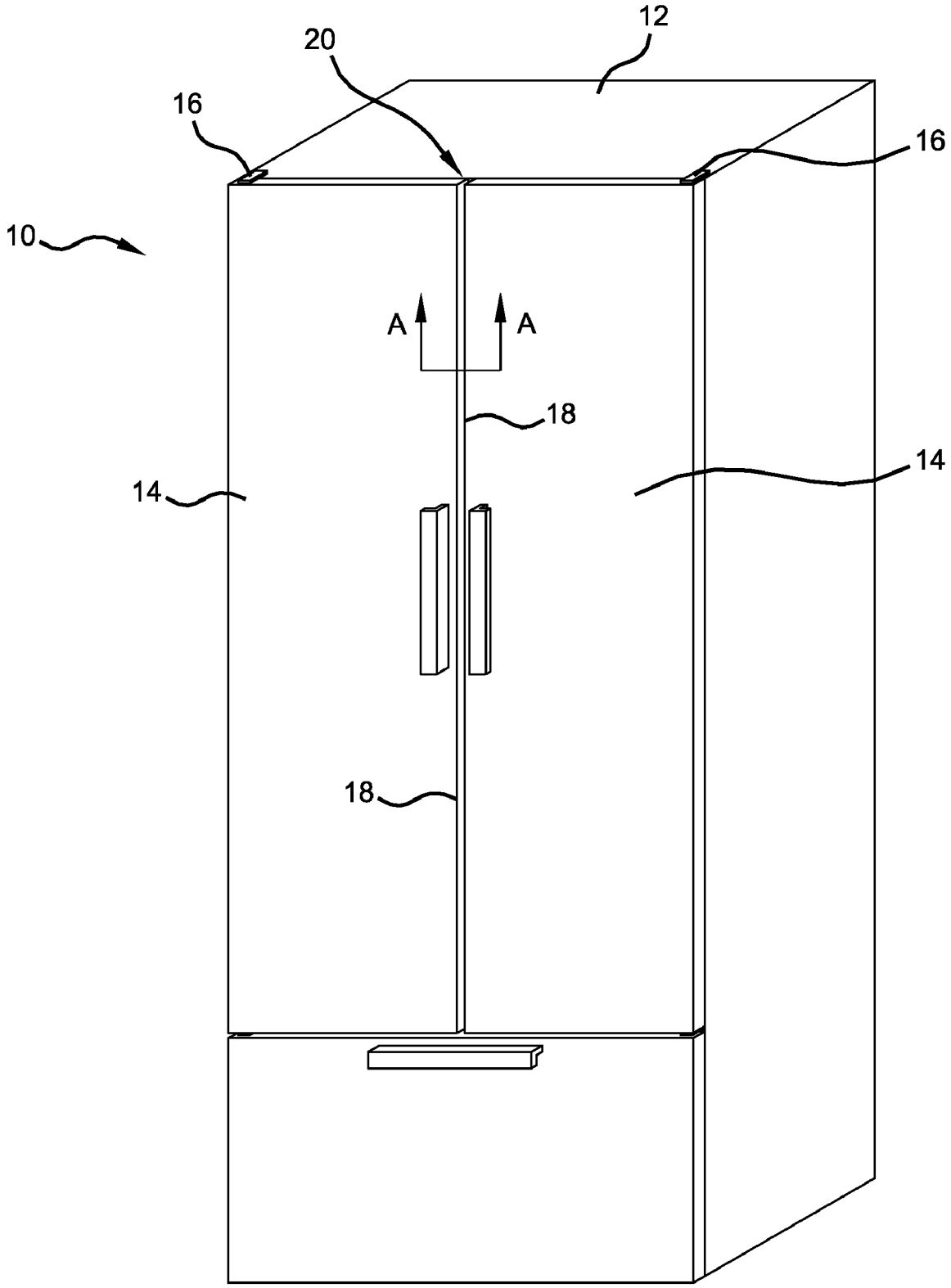
FIG. 1 is perspective view of a refrigerator having side-by-side, or French doors.

The following description is merely exemplary in nature and is not intended to limit the present disclosure, application, or uses. It should be understood that throughout the drawings, corresponding reference numerals indicate like or corresponding parts and features.

Referring to the figures, there is shown a refrigerator 10 having a cabinet 12 with a pair of doors 14 secured to the cabinet 12 by a pair of hinges 16 in a side-by-side or French door configuration. The hinges 16 may be any suitable structure known in the art. Of particular interest for the present invention is the fact that the cabinet does not have a center mullion providing a sealing surface for the doors 14. Thus, the doors 14, and in particular the medial vertical edges 18 thereof must seal upon one another.

Door seal 20 includes a seal assembly 22, 22' supported on each of the medial vertical edges 18. It will be understood from the detailed description and the accompanying drawings that the seal assemblies 22, 22' are mirror images of one another to provide a set of complimentary door seals. As such further description will only reference seal assembly 22 (with it being understood that the structure of seal assembly 22' is the same) unless necessary to full describe the invention. In general, seal assembly 22 includes a base member 24 secured along the vertical edge 18 of door 14 and a seal carrier 26 pivotally coupled to the base member 24. In this manner, a portion of base member 24 and gasket carrier 26 form a hinge 28 such that gasket carrier 26 is able to pivot or rotate relative to base member 24 about a vertical pivot axis 30.

Figure 2:
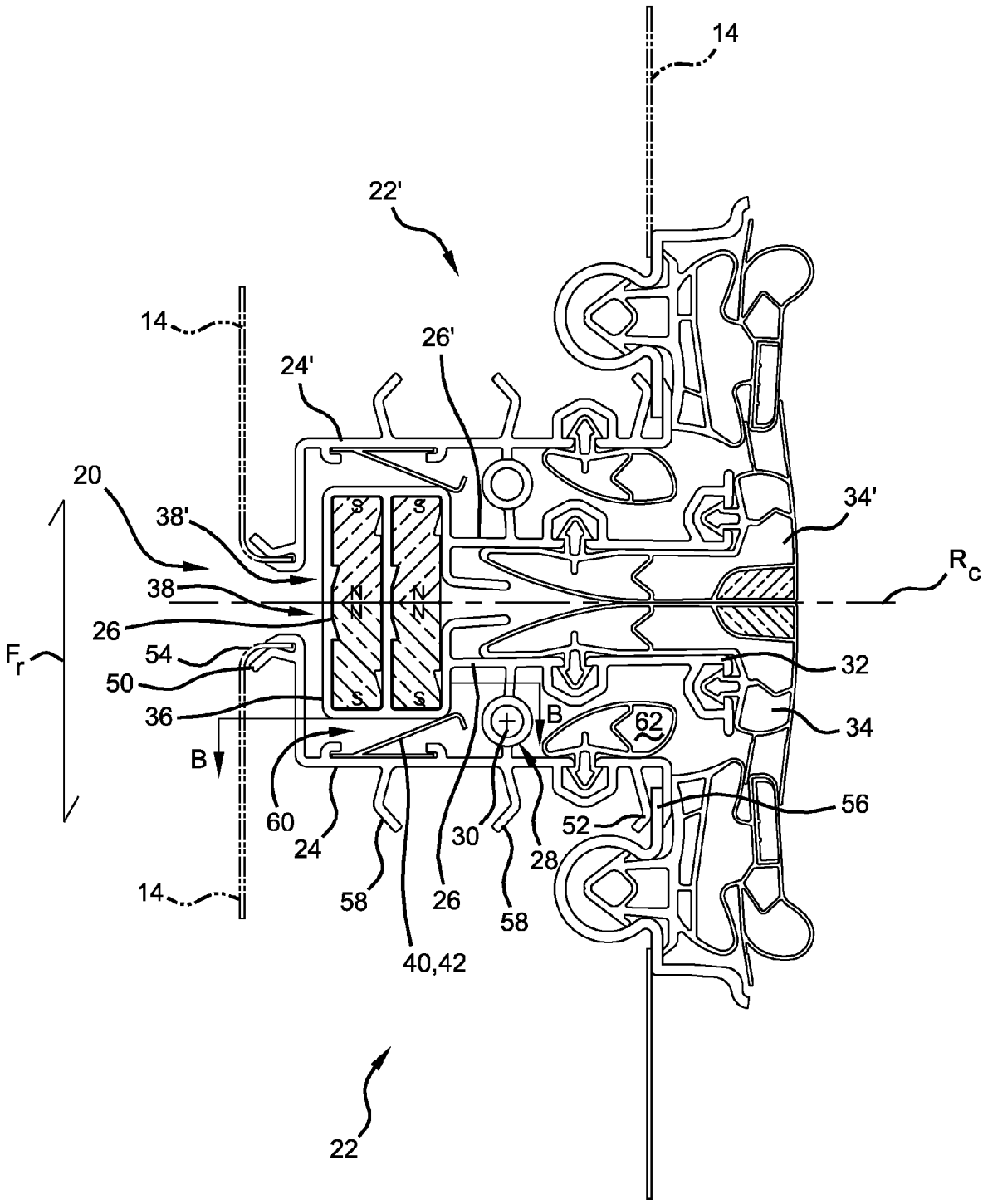
FIG. 2 illustrates a first embodiment of a door seal assembly taken at lines AA of FIG. 1 with the doors in a closed position.
Figure 3:
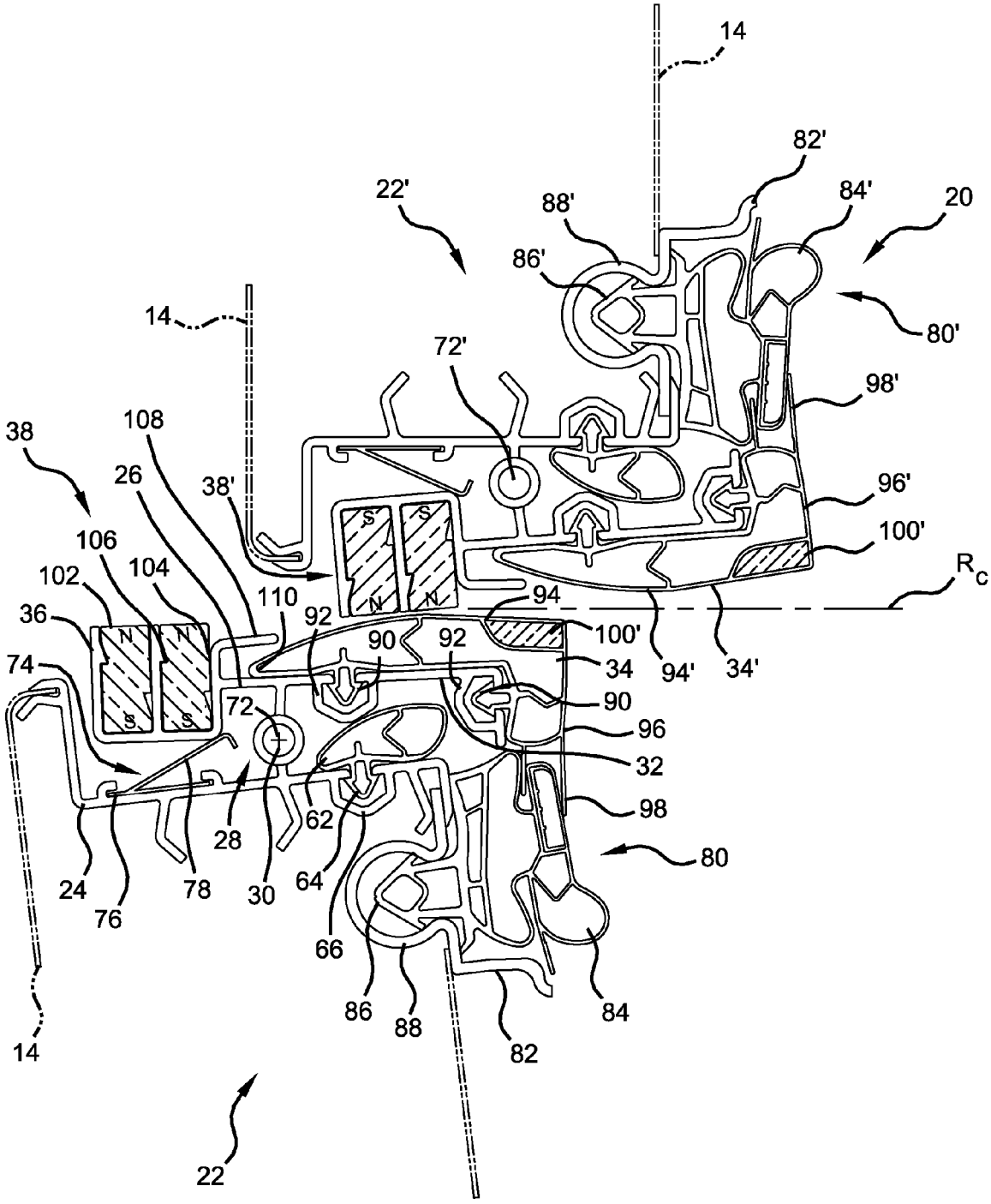
FIG. 3 is a sectional view similar to FIG. 2 with one of the doors located in a partially opened position.
Figure 4:
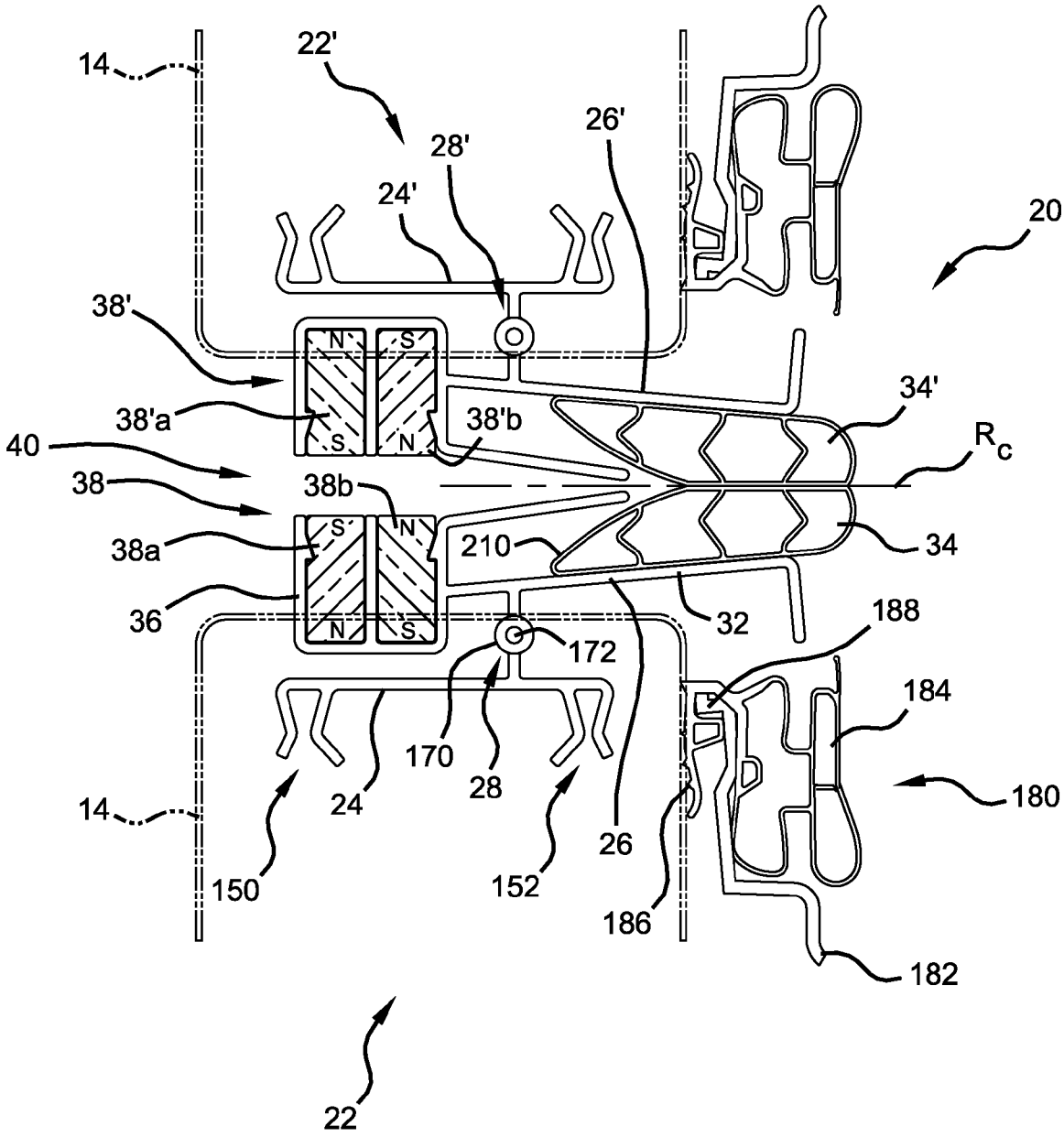
FIG. 4 illustrates a second embodiment of a door seal assembly taken at lines AA of FIG. 1 with the doors located in a closed position.
Figure 5:
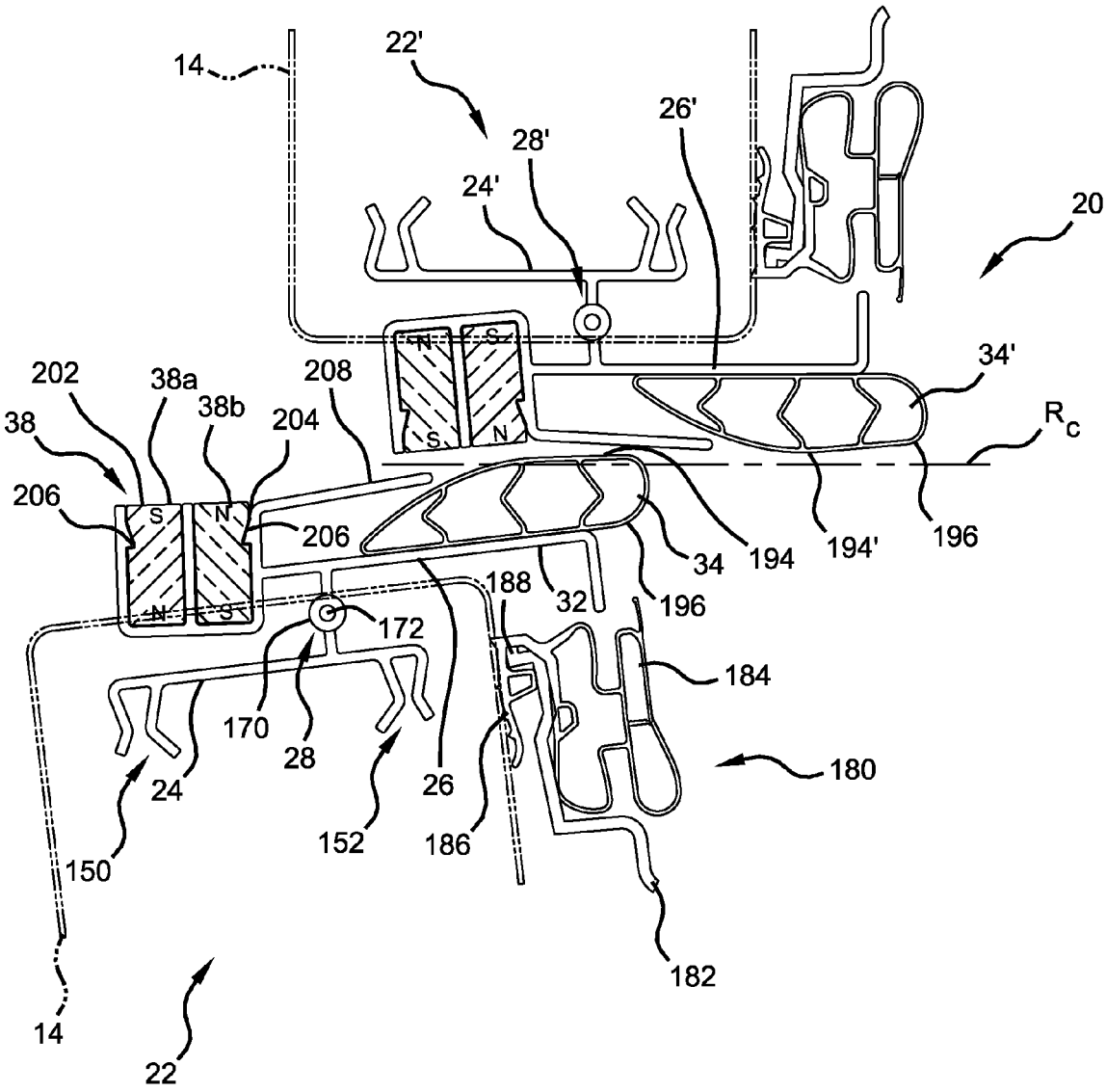
FIG. 5 is a cross-sectional view similar to FIG. 4 with one door located in a partially opened position.

Seal carrier 26 has a gasket flange 32 extending from hinge 28 toward the interior of the cabinet 12 that supports a gasket 34. Similarly, a magnet flange 36 extending from hinge 28 in the opposite direction supports a magnet 38. When doors 14 are in the closed position, as shown in FIGS. 2 and 4, gasket carrier 26 pivots or rotates relative to base member 24 about vertical pivot axis 30 to position gasket 34 into sealing engagement with its companion gasket 34' on seal assembly 22'. The polarity of the magnets 38, 38' are arranged with the same pole proximate one another to generate a repelling force as indicated by arrows $F_r$, which rotates the gaskets 34, 34' into engagement. When doors 14 are moved into the open position as shown in FIGS. 3 and 5, the repelling force is eliminated and gasket carrier 26 counter-rotated relative to base member 24 about vertical pivot axis 30 to position gasket 34 out of sealing engagement with its companion gasket 34' on seal assembly 22'. A biasing element 40 is employed on base member 24 to assist in the counter-rotation of gasket carrier 26.

Figure 6:
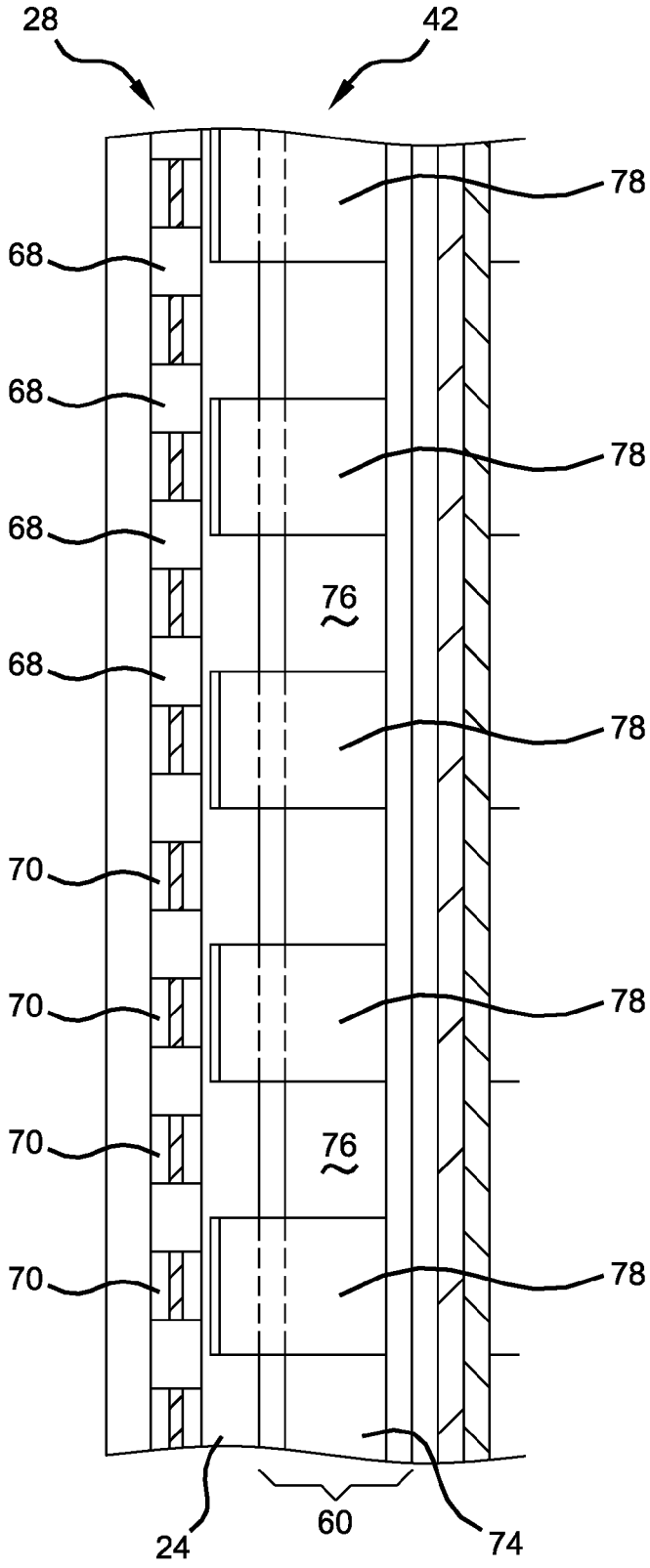
FIG. 6 is a cross-sectional view taken at lines BB of FIG. 2.

In the embodiment shown in FIGS. 2 and 3, biasing element 40 takes the form of a spring element 42 interposed between magnet flange 36 and base member 24. To this end, a series of smaller spring elements 78 (as shown in FIG. 6) may be disposed along the length of the seal assembly 22. Alternately, the leaf portion of leaf spring 40 may be locally removed. In the embodiment shown in FIGS. 4 and 5, biasing element 40 takes the form of a magnet pair 38*a*, 38*b* having opposite polarity on the exposed face thereof. Specifically, the exposed face of magnets 38*a*, 38'*a* has an "S" polarity, whereas the exposed face of magnets 38*b*, 38'*b* has an "N" polarity. As the door 14 is opened, the "N" pole of magnet 38*b* attracts the "S" pole of magnet 38'*a* to counter-rotate seal carrier 26.

With reference now to FIGS. 2 and 3, further details of a first embodiment of door seal 20 will be described. Base member 24 is generally L-shaped and has a retainer 50, 52 formed at each end and adapted to receive a retainer flange 54, 56 formed on the door 14. An additional retainers 58 extend from the central portion of base member 24 for securing the seal assembly 22 to the door 14.

A channel 60 is formed along one face of base member 24 for receiving and supporting spring element 42 on base member 24. An auxiliary seal 62 may be secured to the base member 24 for interrupting the volume between base member 24 and gasket carrier 26. Auxiliary seal 62 functions to disrupt air flow through seal assembly 22, thereby increasing its thermal efficiency. Auxiliary seal 62 is secured to base member 24 by a series of dart 64 which are received in sockets 66 formed in base member 24.

Hinge 28 is a piano-style hinge in which a series of hinge barrels 68 extend from base member 24 and complimentary hinge barrels 70 extend from gasket carrier 26. A best seen in FIG. 6, hinge barrels 68, 70 are interleaved together. A hinge pin 72 extends through hinge barrels 68, 70 to form a pivotable coupling between base member 24 and gasket carrier 26.

With continued reference to FIGS. 2, 3 and 6, spring element 42 is a leaf spring 74 having a suitable spring constant may be employed to bias the seal carrier 26. Leaf spring 74 includes a spring base 76 disposed within channel 60 formed in base member 24 and a spring element 78 extending away from spring base 76 to engage gasket carrier 26. As noted above, the force generated by leaf spring 74 must be sufficient to counter rotate a gasket carrier 26 when the doors 14 are position relative to one another but be overcome by the repelling force generated by the magnet set 38, 38' when the doors 14 are positioned adjacent one another. The leaf spring 74 must have a spring constant such that the biasing force will be overcome by the repelling magnet force $F_R$ generated when the doors 14 are closed, otherwise gaskets 34, 34' will not sealingly engage one another. In this manner, a uniform biasing force may be generated along the length of seal assemblies 22, 22' while satisfying the force balance requirement sufficient to be overcome by the magnet pair 38, 38'.

An interior seal assembly 80, 80' is shown which provides sealing engagement around the lateral vertical edge and upper and lower horizontal edges of door 14. Specifically, interior seal assembly 80, 80' includes a frame 82, 82' secured to door 14 and base member 24 and a gasket 84, 84' coupled to frame 82, 82' by a series of darts 86, 86' received in sockets 88, 88'.

With continued reference to FIGS. 2 and 3, gasket 34 is secured to gasket flange 32 of carrier 26. Specifically, darts 90 extend from gasket 34 into sockets 92 formed on gasket carrier 26. Gasket 34 has an arcuate sealing surface 94 directed towards the interface between doors 14 and a posterior seal portion 96 wrapping around gasket flange 32. A pair of sealing flanges 98 extend from posterior seal portion 96 across a space defined between seal assembly 22 and interior seal assembly 80. A pair of magnets 100 may be disposed within a seal gasket 34 to ensure sealing engagement of the gasket 34 when the doors 14 are in a closed position. Gasket carrier 26 has channels 102, 104 formed in magnet flange portion 36. Channels 102, 104 are adapted to receive a set of magnets which extend along the length of seal assembly 22 and have retaining elements 106 formed therein for releasably securing the magnets 38. A flange 108 extends posteriorly from channel 104 to partially conceal the edge 110 of gasket 34.

With reference now to FIGS. 4 and 5, further details of a second embodiment of door seal 20 will be described. Base member 24 has retainers 150, 152 formed at each end which are adapted to receive a retainer flange (not shown) formed on the door 14. Hinge 28 is a piano-style hinge in which a series of hinge barrels (not shown) extend from base member 24 and complimentary hinge barrels 170 extend from gasket carrier 26. As with the first embodiment, hinge barrels 170 are interleaved together with a hinge pin 172 extends therethrough to form a pivotable coupling between base member 24 and gasket carrier 26.

An interior seal assembly 180 is shown which provides sealing engagement around the lateral vertical edge and upper and lower horizontal edges of door 14. Specifically, interior seal assembly 180 includes a frame 182 secured to door 14 and a gasket 184 coupled to frame 182 with an edge 186 which wraps around bead 188.

Gaskets 34 is secured to gasket flange 32 of carrier 26 by suitable means such as an adhesive. Gaskets 34, 34' have arcuate sealing surfaces 194, 194' directed towards the interface between doors 14 and a posterior seal portion 196 extending beyond gasket flange 32. Gasket carrier 26 has channels 202, 204 formed in magnet flange portion 36. Channels 202, 204 are adapted to receive a set of magnets which extend along the length of seal assembly 22 and have retaining elements 206 formed therein for releasably securing the magnets 38. A flange 208 extends posteriorly from channel 204 to partially conceal the edge 210 of gasket 34. When doors 14 are aligned in the closed position, the exposed faces of magnets 38*a*, 38'*a* which have an "S" polarity are aligned, and the exposed faces of magnet 38*b*, 38'*b* which has an "N" pole are aligned to rotate sealing surfaces 194, 194' into sealing engagement. When doors 14 are slightly misaligned during opening, the "N" pole of magnet 38*b* attracts the "S" pole of magnet 38'*a* to counter-rotate sealing surfaces 194, 194' out of sealing engagement.

Operation of door seal 20 will now be described. In a closed position, as illustrated in FIGS. 2 and 4, doors 14 are located in close proximity with the medial vertical edges 18 in alignment. In this position, the poles of magnets 38, 38' generate a repelling force as indicated by $F_r$ shown, thereby rotating gaskets 34 towards the refrigerator centerline $R_c$. This rotation causes the arcuate sealing surfaces 94, 194 and arcuate sealing surfaces 94', 194' to engage one another such that gaskets 34, 34' are brought into sealing engagement. With respect to the first embodiment, magnets 100, 100' attract one another to further engage the arcuate sealing surface 94, 94'.

When doors 14 are moved apart relative to one another, as illustrated in FIGS. 3 and 5, the repelling force $F_r$ generated by the magnet is eliminated and biasing mechanism 40 biases magnet flange 36 away from base member 24. As a result, a gasket carrier 26 is counter-rotated, moving gasket 34 away from the refrigerator centerline $R_c$ and out of engagement from opposing gasket 34'. With respect to the first embodiment, the counter-rotating force generated by spring element 78 is sufficient to overcome the attractive force generated by magnets 100, 100' and disengage the arcuate sealing surface 94, 94' from one another. With gasket carrier 26 so rotated, the opposing gaskets 34, 34' are no longer in contact and door 14 may be opened freely without scrubbing along the length of seal assembly 22, 22'.

What is claimed is:

1. A door seal for a refrigerator cabinet adapted for securement between confronting medial edges of a pair of doors, the door seal comprising:

a first seal assembly including:

a first base member pivotally coupled to a first gasket carrier by a first hinge;

a first gasket disposed on a posterior portion of said first gasket carrier and having a first sealing surface formed thereon;

a first magnet disposed on an anterior portion of said first gasket carrier;

a second magnet disposed at said posterior portion; and said first hinge being disposed between said posterior portion and said anterior portion;

a second seal assembly including:

a second base member pivotally coupled to a second gasket carrier by a second hinge;

a second gasket disposed on a posterior portion of said second gasket carrier and having a first sealing surface formed thereon;

a third magnet disposed on an anterior portion of said second gasket carrier;

a fourth magnet disposed at said posterior portion; and said second hinge being disposed between said posterior portion and said anterior portion, wherein said first and third magnets define a first magnet pair such that a repelling force is generated between the first and third magnet when the first seal assembly is positioned proximate to the second seal assembly, to rotate the posterior portions of the first and second gasket carriers towards one another such that the first and second gasket are in sealing engagement along the first and second sealing surfaces; and wherein said second and fourth magnets define a second magnet pair such that an attracting force is generated between said second and fourth magnets.

2. The door seal of claim 1, further comprising:

a first biasing mechanism coupled to the first gasket carrier to counter-rotate the first gasket carrier against the repelling force; and a second biasing mechanism coupled to the second gasket carrier to counter-rotate the second gasket carrier against the repelling force.

3. The door seal of claim 1, further comprising:

a first spring element interposed between the first base member and the first gasket carrier to counter-rotate the first gasket carrier against the repelling force; and a second spring element interposed between the second base member and the second gasket carrier to counter-rotate the second gasket carrier against the repelling force.

4. The door seal of claim 1, further comprising a first interior seal assembly coupled to said first base member and a second interior seal assembly coupled to said second base member, said first and second interior seal assemblies sealing a lateral vertical edge and upper and lower horizontal edges of the doors.

5. The door seal of claim 1, wherein said first gasket carrier supports a fifth magnet and said second gasket carrier supports a sixth magnet, a repelling force being generated between said fifth and sixth magnets.

6. The door seal of claim 1, wherein a first auxiliary seal is disposed between said first base member and said first gasket carrier, and a second auxiliary seal is disposed between said second base member and said second gasket carrier.

7. The door seal of claim 1, further comprising a plurality of first leaf springs disposed between said first gasket carrier and said first base member, and a plurality of second leaf springs disposed between said second gasket carrier and said second base member.

8. The door seal of claim 1, wherein each door includes a retainer flange and said first and second seal assemblies are coupled to said retainer flanges.

9. The door seal of claim 1, wherein said second and fourth magnets are disposed in said first and second gaskets, respectively.

* * * * *